US007848861B2

(12) United States Patent
Pollock et al.

(10) Patent No.: US 7,848,861 B2
(45) Date of Patent: Dec. 7, 2010

(54) METHOD AND APPARATUS FOR PROVIDING DIAGNOSTICS OF A LIFTING MAGNET SYSTEM

(75) Inventors: Michael Pollock, Troy, MI (US); Fred Kahl, Grosse Ile, MI (US)

(73) Assignee: Edw. C. Levy Co., Detroit, MI (US)

( * ) Notice: Subject to any disclaimer, the term of this patent is extended or adjusted under 35 U.S.C. 154(b) by 637 days.

(21) Appl. No.: 11/843,904

(22) Filed: Aug. 23, 2007

(65) Prior Publication Data

US 2009/0055039 A1 Feb. 26, 2009

(51) Int. Cl.
*B66C 1/00* (2006.01)

(52) U.S. Cl. ..... 701/29; 701/50; 294/65.5; 715/771; 700/83

(58) Field of Classification Search ..... 701/29, 701/35, 50; 212/270; 335/291, 218, 289, 335/3; 294/65.5, 82.15; 700/213, 83; 715/700, 715/771; *B66C 1/00*
See application file for complete search history.

(56) References Cited

U.S. PATENT DOCUMENTS

| | | | | |
|---|---|---|---|---|
| 1,517,276 | A | 12/1924 | Brooke et al. | |
| 3,629,663 | A | 12/1971 | Butkus | |
| 3,783,344 | A | 1/1974 | Ono et al. | |
| 4,045,756 | A * | 8/1977 | Mueller | 335/292 |
| 4,208,656 | A | 6/1980 | Littwin | |
| 4,210,994 | A | 7/1980 | Schwartz | |
| 4,264,887 | A * | 4/1981 | Barrett | 335/291 |
| 4,323,329 | A * | 4/1982 | Chlad | 414/737 |
| 4,350,379 | A | 9/1982 | Peroutky | |
| 4,368,824 | A | 1/1983 | Thomasson et al. | |
| 4,414,522 | A | 11/1983 | Rybak | |
| 4,509,376 | A | 4/1985 | Thomasson et al. | |
| 4,600,964 | A | 7/1986 | Ela et al. | |
| 4,965,695 | A | 10/1990 | Baumann | |
| 5,114,025 | A * | 5/1992 | Verreet | 212/274 |
| 5,166,654 | A | 11/1992 | Doyelle | |
| 5,297,019 | A | 3/1994 | Zuehlke | |

(Continued)

FOREIGN PATENT DOCUMENTS

JP 06-127886 5/1994

(Continued)

OTHER PUBLICATIONS

Examination report from the Australian Patent Office dated Jan. 25, 2010 for Application No. 2008203831.

(Continued)

*Primary Examiner*—Tuan C To
(74) *Attorney, Agent, or Firm*—Honigman Miller Schwartz and Cohn LLP

(57) ABSTRACT

An apparatus for providing diagnostics of a work device includes an electric crane including an operator cabin and a derrick that supports a lifting magnet; a diagnostic panel disposed proximate the operator cabin; a device that provides one or more operating parameters associated with an operation of the electric crane; and a logic controller in communication with the device and diagnostic panel. The logic controller receives the one or more operating parameter. The diagnostic panel provides one or more quantifiable diagnostics of the electric crane and/or magnet according to the one or more operating parameters received by the PLC. A method is also disclosed.

24 Claims, 3 Drawing Sheets

U.S. PATENT DOCUMENTS

| | | | | |
|---|---|---|---|---|
| 5,325,260 | A | 6/1994 | Repetto | |
| 5,382,935 | A | 1/1995 | Doyelle | |
| 5,730,305 | A | 3/1998 | Ichiba et al. | |
| 5,748,062 | A | 5/1998 | Kirkpatrick | |
| 5,813,712 | A | 9/1998 | Mozelt et al. | |
| 5,905,624 | A * | 5/1999 | Andreica et al. | 361/144 |
| 5,998,944 | A * | 12/1999 | Clutter et al. | 318/141 |
| 6,076,873 | A | 6/2000 | Jung | |
| 6,124,798 | A | 9/2000 | Tai et al. | |
| 6,303,882 | B1 | 10/2001 | Stephens et al. | |
| 6,744,372 | B1 | 6/2004 | Shaw et al. | |
| 6,767,177 | B2 | 7/2004 | Opitz | |
| 7,505,871 | B2 * | 3/2009 | Grant et al. | 702/185 |
| 7,599,762 | B2 * | 10/2009 | Discenzo et al. | 701/1 |
| 2002/0156558 | A1 * | 10/2002 | Hanson et al. | 701/33 |
| 2003/0194305 | A1 | 10/2003 | Opitz | |
| 2004/0032140 | A1 * | 2/2004 | Solstad | 294/82.15 |
| 2006/0176635 | A1 | 8/2006 | Thexton et al. | |
| 2006/0209024 | A1 | 9/2006 | Gharsalli | |
| 2007/0156280 | A1 * | 7/2007 | Morath | 700/213 |

FOREIGN PATENT DOCUMENTS

| | | | |
|---|---|---|---|
| JP | 07-81887 | | 3/1995 |
| JP | 2002187689 | | 7/2002 |
| JP | 2002342544 | | 11/2002 |
| JP | 2006315814 | A * | 11/2006 |
| JP | 2007039984 | A * | 2/2007 |
| WO | WO-00/06480 | | 2/2000 |

OTHER PUBLICATIONS

Examination Report from the European Patent Office for Application 08 252 594.0 dated Jul. 22, 2010.

* cited by examiner

METHOD AND APPARATUS FOR PROVIDING DIAGNOSTICS OF A LIFTING MAGNET SYSTEM

TECHNICAL FIELD

The invention relates in general to lifting magnet systems and to a method and apparatus for providing diagnostics of a lifting magnet system.

BACKGROUND

Electro-magnetic lifting magnets are commonly associated with cranes. Cranes with lifting magnets are utilized for manipulating relatively heavy magnetic materials, such as, for example, scrap steel, ferrous material, and the like.

In some situations/environments, a crane operator may willfully or unintentionally impart damage to the lifting magnet. For example, referring to FIG. 3, if an electric current is delivered, without interruptions, or, with shorts interruptions, the lifting magnet may not adequately cool down such that the temperature of lifting magnet steadily increases during the above-described period(s) when the lifting magnet is not provided with an adequate rest period. This increase in temperature of the lifting magnet, however, typically detracts from its magnetic strength; to compensate for this loss of magnetic strength, the operator may have to resort to increasing current flow to the magnet, which may solve the immediate problem by re-establishing the magnet's strength while concurrently increasing the likelihood of causing destruction to/failure of the lifting magnet should the magnet temperature exceed a critical temperature, $T_C$.

Even further, if, for example, the crane operator moves the magnet in a manner that imparts high accelerations thereto, or, alternatively, a sudden, free-fall dropping movement of the magnet/the handled material, the end result may include a whipping of the crane's derrick and/or voltage spiking that is seen across the magnet.

If such willful/unintentional operation of the lifting magnet is conducted over a period of time, the damage imparted to the lifting magnet may result in financial loss and/or down-time of the operation of the crane in addition to the cost to repair the lifting magnet. Without a supervisor having knowledge of the willful/unintentional damage to the lifting magnet by a particular operator of the crane, it may be otherwise difficult to identify a particular operator that caused the damage, or, hold a crane operator accountable for the undesirable operation of the lifting magnet and crane that may eventually result in damage to the crane and/or magnet.

Accordingly, there is a need in the art for method and apparatus for providing diagnostics of a crane and/or lifting magnet.

BRIEF DESCRIPTION OF THE DRAWINGS

The disclosure will now be described, by way of example, with reference to the accompanying drawings, in which.

DETAILED DESCRIPTION

The Figures illustrate an exemplary embodiment of a method and apparatus for providing diagnostics of a lifting magnet system in accordance with an embodiment of the invention. Based on the foregoing, it is to be generally understood that the nomenclature used herein is simply for convenience and the terms used to describe the invention should be given the broadest meaning by one of ordinary skill in the art.

Figure 1:
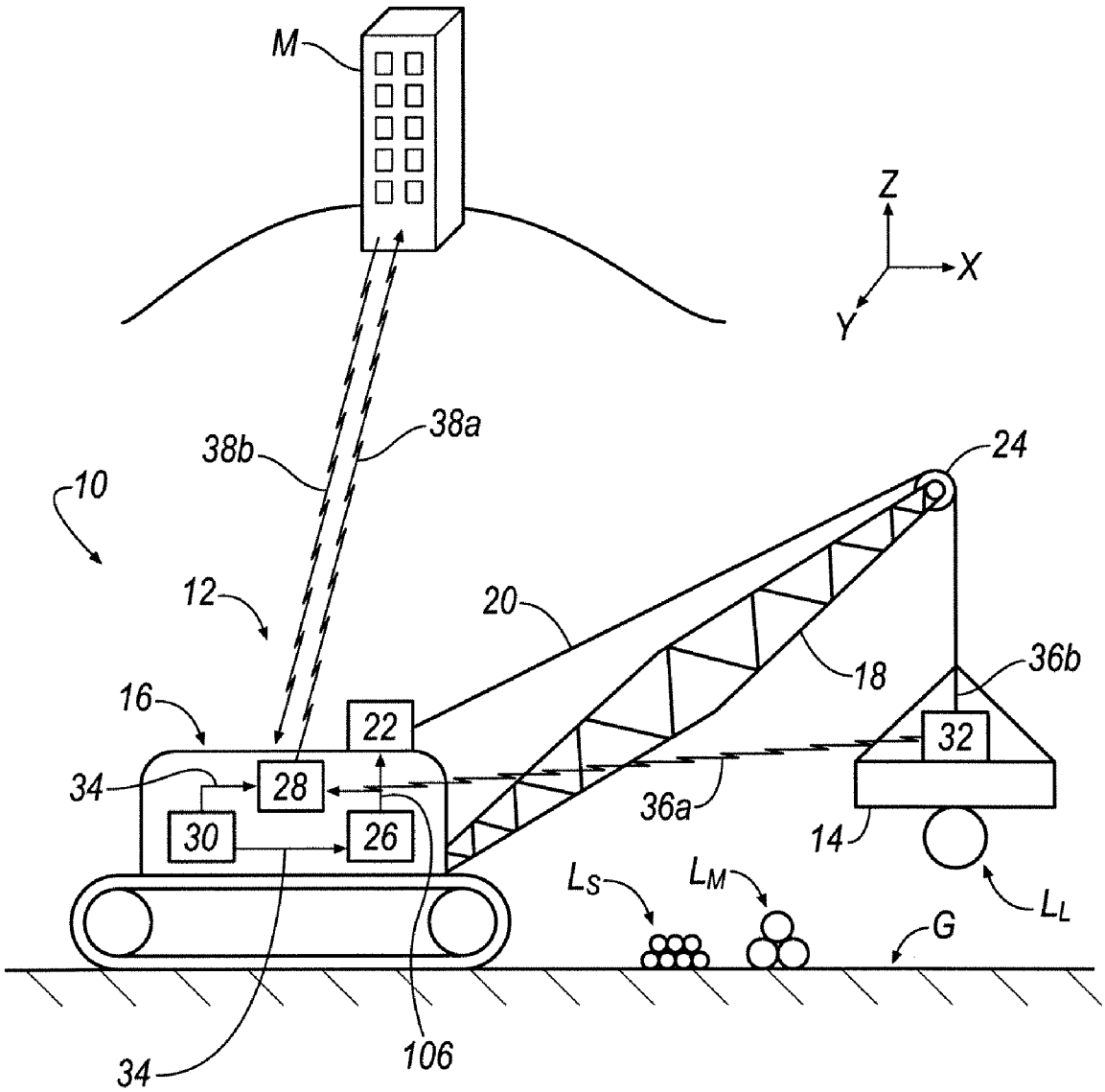
FIG. 1 illustrates an environmental view of a lifting magnet system in accordance with an exemplary embodiment of the invention.

Referring to FIG. 1, a lifting magnet system for moving magnetic material is shown generally at 10, according to an embodiment. The lifting magnet system 10 is generally defined to include a crane 12 and an electromagnet referred to herein as a lifting magnet 14. The lifting magnet system 10 is further defined to include a crane operator cabin 16 and a crane derrick 18. The crane 12 also includes a lift cable 20 that is reeled from a hoist assembly including a hoist motor 22.

The lift cable 20 is supported by a pulley 24 located at an end of the derrick 18, which serves as a bearing surface for spatially supporting (according to an X-Y-Z axial coordinate) the lifting magnet 14 above ground, G, by way of the lift cable 20. According to an embodiment, the lift cable 20 may provide a dual function in that the lift cable 20 structurally supports the load of the magnet 14 while also serving as a support structure/carrier for supporting an electric conductor (not shown) used to deliver electrical current to lift magnet 14 from magnet controller 26.

According to an embodiment, although not required, the magnet controller 26 is shown generally disposed within the operator cabin 16. According to an embodiment, the magnet controller 26 may provide a flow of current to the lifting magnet 14 in order to create a magnetic field about the magnet 14 for lifting magnetic material, such as, for example, a small load, $L_S$, a medium-sized load, $L_M$, or a larger load, $L_L$.

According to an embodiment, although not required, a controller 28, such as, for example, a programmable logic controller (PLC) is shown generally disposed within the operator cabin 16. As illustrated, the PLC 28 may receive information from operator inputs 30, which may include, for example, joy sticks, levers, dials, switches, or the like. In addition, the operator inputs 30 may be provided directly to the magnet 14 and/or hoist motor 22 by way of the magnet controller 26. In an embodiment, the operator inputs 30 may include levers, dials, and/or switches for initiating the energizing and de-energizing of the magnet 14 that, respectively, activates or deactivates a magnetic field about the magnet 14 for respectively retaining, moving, and releasing the load $L_S$, $L_M$, $L_L$ therefrom.

The inclusion of the PLC 28 in the lifting magnet system 10 provides for a "tattle-tale" operation of the crane 12 by monitoring and recording operating parameters related to the crane 12 and magnet 14. Although operator-imparted information 34 may be provided to the PLC 28 from the operator inputs 30, the PLC 28 may also receive quantifiable diagnostic information 36*a*, 36*b* from a diagnostic device 32 associated with the crane 12 and/or magnet 14. The device 32 may include, for example, a load cell, an imaging camera, a magnet core/casing temperature sensor, an accelerometer, or the like. Although FIG. 1 illustrates one device 32 located on a magnet 14, it will be appreciated that more than one device 32 may be associated with the lifting magnet system 10 and that the one or more devices 32 may be positioned on, within, or proximate the magnet 14, operator cabin 16, derrick 18, or the like.

In operation, the PLC 28 monitors and records an operator's control over the crane 12 and/or the magnet 14. Accordingly, in an embodiment, the control signal 34 sent to the controller 26 from the operator inputs 30 may also be directly monitored and recorded by the PLC 28. In another embodiment, once the control signal 34 causes the magnet 14 to react in a manner as desired by the operator, the quantifiable diagnostic operation parameter 36*a*, 36*b* for the crane 12 and/or magnet 14, as sensed/detected by one or more devices 32, may be monitored and recorded by the PLC 28. In an embodiment, the operation parameter 36*a* may be wirelessly communicated to the PLC 28. In another embodiment, the operation parameter 36*b* may be sent over a hardwire connection on/along, for example, the lift cable 20.

Figure 2:
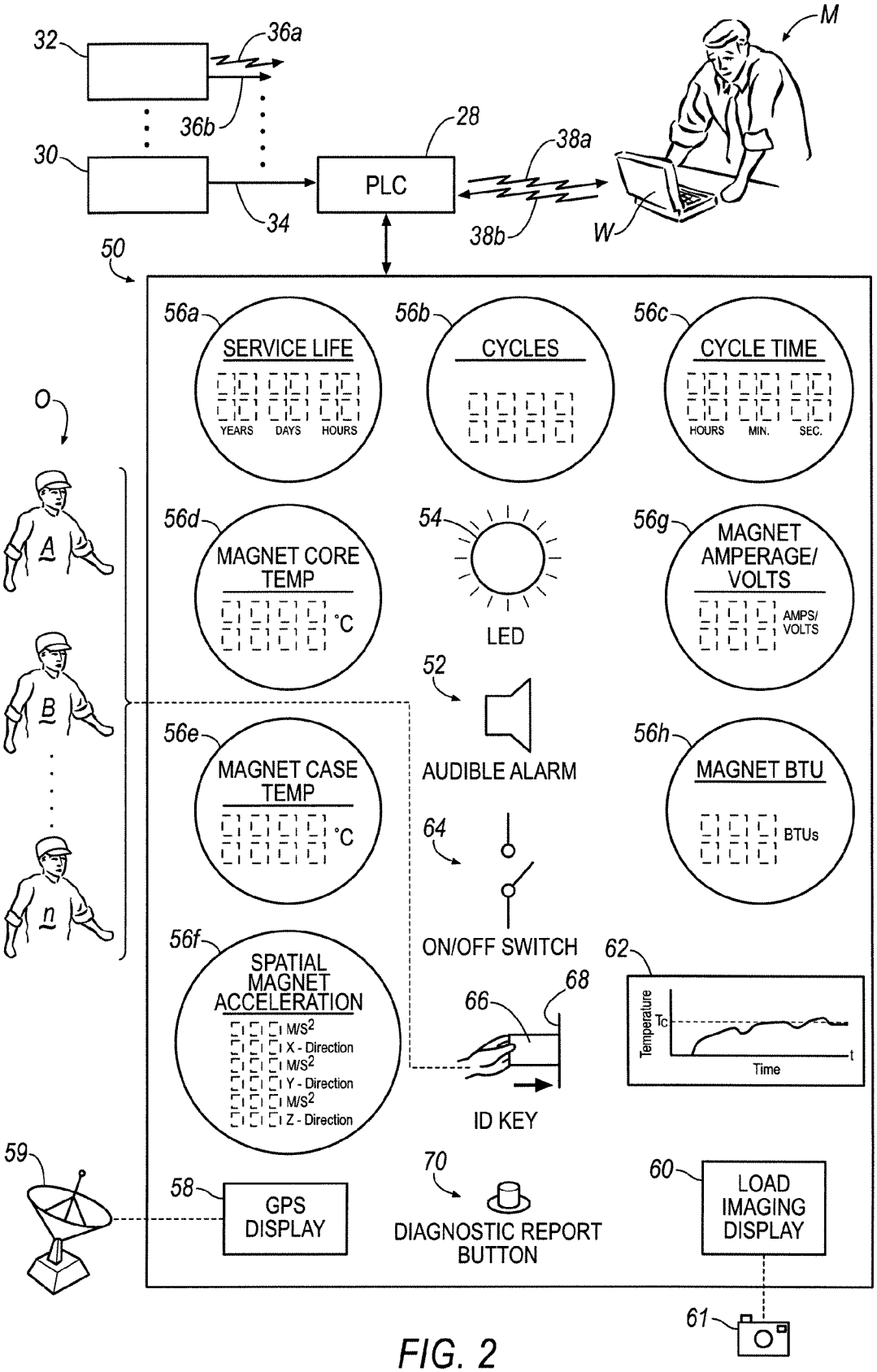
FIG. 2 is a block diagram of a method and apparatus for providing diagnostics of a lifting magnet system in accordance with an exemplary embodiment of the invention.
Figure 3:
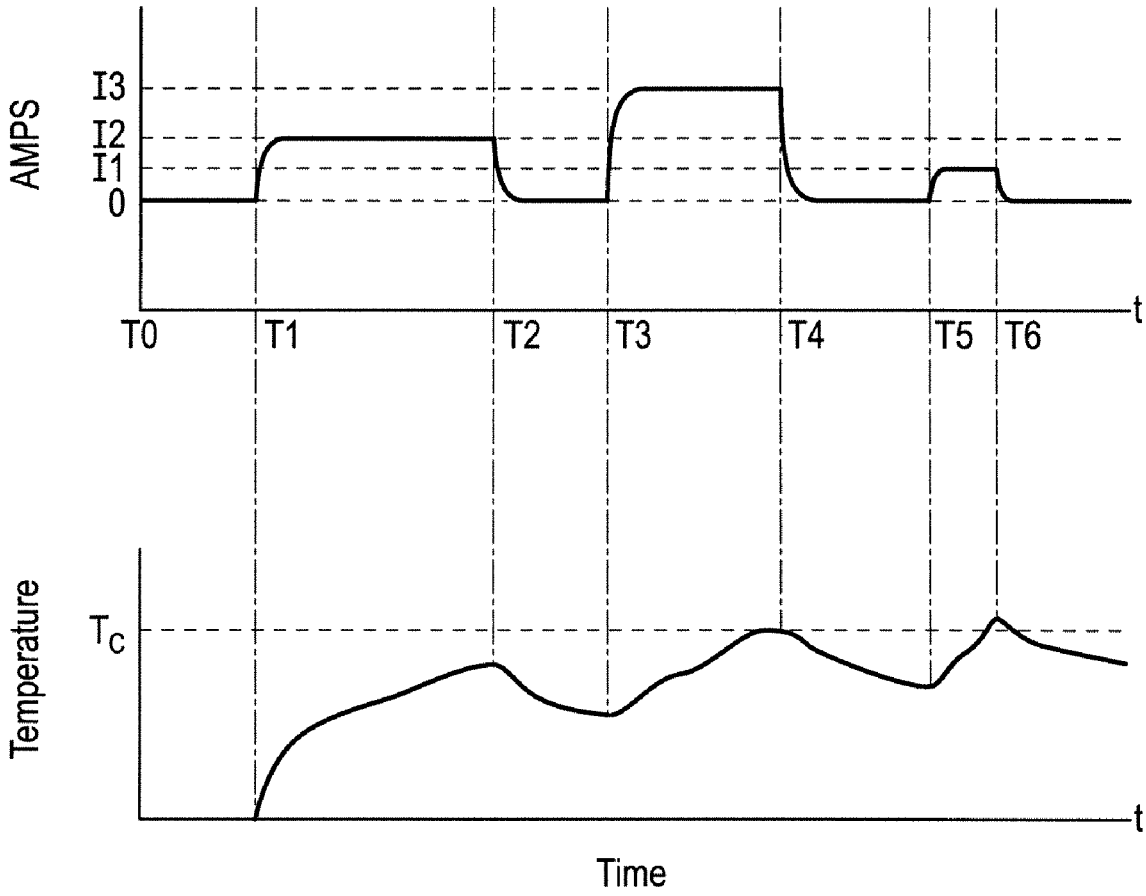
FIG. 3 is a timing diagram associated with the operation of a lifting magnet system.

Referring to FIG. 2, a diagnostic panel is shown generally at 50 according to an embodiment. The diagnostic panel 50 may be located on/proximate a dash board (not shown) and within, for example, the operator cabin 16 to permit the operator to have access to diagnostic information pertaining to the lifting magnet system 10.

According to an embodiment, the diagnostic panel 50 provides a plurality of visual and/or audible indicators related to the operation of the crane 12 and/or magnet 14 as provided by the operation parameter(s) 36*a*, 36*b* and/or operator control signal 34. As such, from within the operator cabin 16, the diagnostic panel 50 may provide an operator with immediate/real time access to the health/desired operability of the crane 12 and/or magnet 14.

In an embodiment, for example, if a monitored parameter 36*a*, 36*b* and/or signal 34 of the system 10 is determined by the PLC 28 to be quantified as being related to potential damage and/or failure of the crane 12 and/or magnet 14, an audible indicator (e.g., a speaker), which is shown generally at 52 may provide an audible alert to the operator. Similarly, a visual indicator may include a light emitting diode (LED) 54, and, the LED 54 may be activated to emit light when the PLC 28 quantifies a parameter 36*a*, 36*b* related to potential damage and/or failure of the crane 12 and/or magnet 14.

If desired, according to an embodiment, the speaker 52 and LED 54 may provide a simultaneous audible and visual alert. If desired, according to an embodiment, the speaker 52 and LED 54 may be activated independently of one another depending on the quantification of the monitored parameter 36*a*, 36*b*. If desired, according to an embodiment, the audible and/or visual alert may be intermittently activated and/or increase/decrease in decibel level/brightness according to the quantification of the monitored parameter 36*a*, 36*b*.

In addition to audible and/or visual alerts provided by the speaker 52 and LED 54, additional visual indicator(s) may be provided by one or more alpha-numeric displays 56*a*-56*h*. The one or more alpha-numeric displays 56*a*-56*h* may provide an indication of a quantification of any desired parameter 36*a*, 36*b* and/or signal 34 of the lifting magnet system 10 from one or more of the operator inputs 30 and devices 32. In an embodiment, the displays 56*a*-56*h* may provide real-time operator inputs 30 and/or parameter information 36*a*, 36*b* of the lifting magnet system 10. In an embodiment, the real-time data may provide the operator, O, with a sense of urgency to maintain or change the operation of the crane 12 and/or magnet 14 according to the health of the crane 12 and/or magnet 14 as indicated by the diagnostic panel 50.

In an embodiment, a visual indicator provided on the diagnostic panel 50 may also include a global positioning system (GPS) display 58. The GPS display 58 may provide an indication to the operator, O, where the crane 12 is located relative the ground, G, in a work environment. According to an embodiment, for example, the device 32 may include, for example, a GPS antenna 59 that provides the GPS display 58 with positioning information according to the GPS antenna 59. As shown in FIG. 2, for example, it will be appreciated that the GPS antenna 59 is not limited to being located at the device 32, but rather, may be located, for example, proximate the operator cabin 16.

In an embodiment, a visual indicator may also include a load imaging display 60. According to an embodiment, the device 32 may include a camera 61 that provides images to the display 60 of a load $L_S$, $L_M$, $L_L$ that is (to be) retained by the magnet 14; if the operator, O, may visualize and be aware of the size of the load, the operator, O, may be more inclined to provide the magnet 14 with a rest period for an extended period of time to obviate an over-heating condition of the magnet 14. In addition, as explained in further detail below, a supervisor/management, M, may also have access to the information presented on the diagnostic panel 50, and, as such, if a supervisor/management, M, is able to visualize the images provided by the camera 61, the supervisor/management, M, may be able to better understand the willfulness of potential damage imparted to the crane 12 and/or magnet 14 by way of the operator, O.

In an embodiment, a visual indicator may also include a timing diagram display 62. According to an embodiment, the device 32 may include, for example, a magnet/case temperature sensor that provides, for example, temperature data of one or more of the magnet 14 and/or its casing to the display 62. The display 62 may, accordingly, provide a graph of the temperature data over time for presentation to the operator to provide the operator, O, with the temperature of the magnet 14 to obviate an over-heating condition should the temperature of the magnet 14 exceed a critical temperature, $T_C$.

In addition to the one or more audible and/or visual indicators 52-62, the diagnostic panel 50 may also include a plurality of inputs. In an embodiment, an input may include an on/off switch 64. In an embodiment, an input may include an operator identification key 66 for receipt in a key-hole 68 to identify a particular operator, O, selected from the group of operators, A-n, that may have access to the operator cabin 16 and operator inputs 30. Although a key/key-hole 66/68 is shown, other operator identifiers, such as, for example, a finger print/retinal scanner may be used instead of a unique key 66. In an embodiment, an input may also include a diagnostic report button, which is shown generally at 70, that may produce, for example, a report (in soft- or hard-copy form) of the monitored operation parameters 36*a*, 36*b* and/or signal 34.

In operation, the one or more alpha-numeric displays 56*a*-56*h* may provide any desirable parameter/unit of information pertaining to the operation of the crane 12 and/or magnet 14. For example, the display 56*a* may provide an indication of the service life, as measured, for example, in years, days, and hours of the lifting magnet system 10. The service life 56*a* may be referenced from, for example, each moment the lifting magnet system 10 is keyed-on, or, alternatively, the moment the switch 64 is moved to an "on" position. In an embodiment, the PLC 28 may be programmed to prevent operation of the lifting magnet system 10 until an operator has moved the switch 64 to the "on" position, and, when the operator has inserted the identification key 66 into the key-hole 68; thus, the PLC 28 may appropriately monitor a particular operator's actions the moment the lifting magnet system 10 is activated.

The display 56*b* may, for example, provide an indication of the number of cycles conducted by the lifting magnet system 10. According to an embodiment, a 'cycle' may be defined by the magnetization of the magnet 14 followed by a de-magnetization of the magnet 14. The number of cycles provided on the display 56*b* may include, for example, the number of cycles conducted by the lifting magnet system 10 over its entire service life, or, alternatively, the number of cycles conducted during the period when the switch 64 is moved to the "on" position.

The display 56*c* may, for example, provide an indication of the amount of time that the lifting magnet system 10 has been cycled. According to an embodiment, the amount of time that the system 'has been cycled' may be defined by a discreet period of time, or, alternatively, a summation of the time that the magnet 14 has been magnetized. The cycle time provided on the display 56*c* may include, for example, a summation of the cycle time conducted by the lifting magnet system 10 over its entire service life, or, alternatively, the summation of the cycle time conducted during the period when the switch 64 is moved to the "on" position. Alternatively, if desired, the cycle time provided on the display 56*c* may be a summation of an individual cycle (i.e., the period when the magnet 14 is magnetized and de-magnetized).

The displays 56*d*, 56*e* may, for example, provide a core temperature of the magnet 14 and a case temperature of the magnet 14. The temperature may be provided from the device 32, which may include, for example, a temperature sensor.

The display 56*f* may, for example, provide a spatial acceleration of the magnet 14 according to X-Y-Z coordinates. According to an embodiment, the device 32 may include an accelerometer that determines spatial acceleration of the magnet 14 for visualization on the display 56*f*.

The display 56*g* may, for example, provide a reading of the amperage through/voltage across the magnet 14. The amperage through/voltage across the magnet 14 may be provided according to a setting of operator inputs 30.

The display 56*h* may, for example, provide a reading of power being utilized to operate the magnet 14 in, for example, British thermal units (BTUs). The reading, in BTUs, may be calculated by the PLC 28 (according to $I^2R$ characteristics of the magnet 14).

Accordingly, the PLC 28 may provide the operator, O, with feedback on his/her performance during, or, as a summation at the end of an operator's shift, regarding the operation of the lifting magnet system 10. If provided during the operation of the system 10, the real-time feedback instills a sense of urgency in the operator, O, to operate the lifting magnet system 10, as desired by a supervisor/management, M.

According to an embodiment a manufacturer may originally program the PLC 28 and/or the supervisor/management, M, may have access to the settings stored on the PLC 28, such that the supervisor/management, M, may program the PLC 28 in a manner to provide the audible and/or visual warnings at 52, 54 when a monitored parameter 36*a*, 36*b* or signal 34 exceeds a diagnostic threshold value as suggested by the supervisor/management, M. Diagnostic threshold values may include, for example, a case/magnet temperature and/or voltage that may cause damage to the lifting magnet system 10.

Because the PLC 28 may monitor and record the operating parameters 36*a*, 36*b*, the supervisor/management, M, may have access to and monitor real-time operation of a lifting magnet system 10 of a particular operator, O, or, for example, a fleet of lifting magnet systems 10 being operated by a group of operators, A-n. In an embodiment, the PLC 28 may communicate the operating parameters 36*a*, 36*b* wirelessly, at 38*a*, to a supervisor's workstation, W, such that the PLC 28 "tattle-tells" on the operator's control over the lifting magnet system 10.

If, for example, the supervisor/management, M, does not agree with/approve of the operation of a particular operator's control over a lifting magnet system 10, the supervisor/management, M, may wireless communicate, at 38*b*, a message to the operator, O, to change his/her operation of the lifting magnet system 10. In an embodiment, the message communicated at 38*b* may include text that is provided, for example, on one of the displays 58, 62, 64. In an embodiment, the message 38*b* may include the audible voice of the supervisor/management, M, from the speaker 52. In yet another embodiment, the message 38*b* may include a signal that moves the switch 64 from the "on" position to an "off" position such that the supervisor/management, M, may intervene and independently shut-down or interrupt the operator of the lifting magnet system 10 if the supervisor/management, M, determines that the operator, O, may potentially cause immediate or subsequent damage to the crane 12 and/or magnet 14 if further operation of the system 10 by the operator, O, is permitted. However, if the supervisor/management, M, does not wish to intervene during the operation of the system 10, the supervisor/management, M, may alternatively press a diagnostic report button 70 located on his/her workstation, W, to obtain evidence of the operator's control over the crane 12 and/or magnet 14 for use during a subsequent performance review.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters; and wherein the one or more quantifications include a temperature of the magnet.

2. The apparatus according to claim 1, wherein the logic controller is a programmable logic controller.

3. The apparatus according to claim 2, wherein the device is selected from the group consisting of a load cell, an imaging camera, a satellite antenna, a magnet core/casing temperature sensor, and an accelerometer.

4. The apparatus according to claim 1 wherein the operator cabin includes operator input controls that are in communication with the logic controller, wherein the logic controller receives input signals related to the manipulation of the operator input controls.

5. The apparatus according to claim 1, wherein the operating parameters are communicated wirelessly to the PLC.

6. The apparatus according to claim 1, wherein the operating parameters are communicated over a hardwire connection provided by a magnet lift cable.

7. The apparatus according to claim 1, wherein the diagnostic panel includes one or more audible alerting devices.

8. The apparatus according to claim 1, wherein the diagnostic panel includes one or more visual alerting devices.

9. The apparatus according to claim 1, wherein the diagnostic panel includes a global positioning system display in communication with a global positioning display antenna associated with the electric crane.

10. The apparatus according to claim 3, wherein the diagnostic panel includes a load imaging display in communication with the camera for providing images of a load ($L_S$, $L_M$, $L_L$).

11. The apparatus according to claim 1, wherein the diagnostic panel includes an on/off switch, a key-hole for receiving an identification key, and a diagnostic report button.

12. The apparatus according to claim 1, wherein the diagnostic panel includes a timing diagram display that provides a real-time timing diagram including a graph of the one or more quantifications.

13. The apparatus according to claim 1, wherein the one or more quantifications include a service life time of the electric crane and/or magnet.

14. The apparatus according to claim 1, wherein the one or more quantifications include a number of cycles of the magnet.

15. The apparatus according to claim 14, wherein the one or more quantifications include an amount of time that the magnet has been cycled.

16. The apparatus according to claim 1, wherein the one or more quantifications include a spatial acceleration of the crane and/or magnet.

17. The apparatus according to claim 1, wherein the one or more quantifications include an amperage/voltage across the magnet.

18. The apparatus according to claim 1, wherein the one or more quantifications include an amount of power utilized to operate the magnet.

19. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the diagnostic panel includes a timing diagram display that provides a real-time timing diagram including a graph of the one or more quantifications.

20. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the one or more quantifications include a service life time of the electric crane and/or magnet.

21. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the one or more quantifications include a number of cycles of the magnet.

22. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the one or more quantifications include a spatial acceleration of the crane and/or magnet.

23. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the one or more quantifications include an amperage/voltage across the magnet.

24. An apparatus for providing diagnostics of a work device, comprising:

an electric crane including an operator cabin and a derrick that supports a lifting magnet;

a diagnostic panel disposed proximate the operator cabin;

a device that provides one or more operating parameters associated with an operation of the electric crane; and a logic controller in communication with the device and diagnostic panel, wherein the logic controller receives the one or more operating parameter, wherein the diagnostic panel provides one or more quantifiable diagnostics of the electric crane and/or magnet according to the one or more operating parameters received by the PLC;

wherein the diagnostic panel includes one or more alpha-numeric displays;

wherein one or more of the alpha-numeric displays provides one or more quantifications of the one or more operating parameters;

wherein the one or more quantifications include an amount of power utilized to operate the magnet.

* * * * *